US005402592A

United States Patent [19]

Caveney et al.

[11] Patent Number: 5,402,592

[45] Date of Patent: Apr. 4, 1995

[54] EMBOSSED PIPE MARKER

[75] Inventors: Jack E. Caveney, Hinsdale; Joseph A. Chopp, Jr., New Lenox; Bernard J. O'Grady, Oak Lawn, all of Ill.

[73] Assignee: Panduit Corp., Tinley Park, Ill.

[21] Appl. No.: 910,047

[22] Filed: Jul. 8, 1992

[51] Int. Cl.[6] ..... G09F 3/10

[52] U.S. Cl. ..... 40/665; 40/316

[58] Field of Search ..... 40/665, 316, 310; 138/104

[56] References Cited

U.S. PATENT DOCUMENTS

| | | | |
|---|---|---|---|
| 231,277 | 8/1880 | Cohen | 40/665 |
| 416,472 | 12/1889 | Loughery | 40/665 |
| 573,870 | 12/1896 | Geoffroy | 40/665 |
| 1,227,122 | 5/1917 | Eberhart | 40/665 |
| 1,486,850 | 3/1924 | Avery et al. | 40/665 |
| 2,059,292 | 11/1936 | Taylor | 40/616 |
| 2,188,710 | 1/1940 | Giovanini et al. | 40/665 |
| 2,839,088 | 6/1958 | Biklen | 40/316 X |
| 3,486,257 | 12/1969 | Walldorf | 40/299 |
| 3,491,470 | 1/1970 | Geisinger | 40/661 |
| 4,033,057 | 7/1977 | Jaffe | 40/316 |
| 4,246,712 | 1/1981 | Vander Wall | 40/316 |
| 4,275,768 | 6/1981 | Riggs et al. | 138/104 |
| 4,399,592 | 8/1983 | Chopp, Jr. et al. | 24/25 |

FOREIGN PATENT DOCUMENTS

| | | | |
|---|---|---|---|
| 0064708 | 11/1982 | European Pat. Off. | 40/316 |

*Primary Examiner*—Kenneth J. Dorner
*Assistant Examiner*—Cassandra Davis
*Attorney, Agent, or Firm*—Charles R. Wentzel; Mark D. Hilliard; Robert A. McCann

[57] ABSTRACT

An information marker for conforming display around an elongate object having a longitudinal axis includes a planar information display surface of sufficient flexibility to conform to the shape of the elongate object, a plurality of embossments in the information display surface arranged to display an informational symbol field, wherein longer peripheral edges of each of the embossments are aligned parallel to an embossment alignment direction, and a fastener for securing the marker around the elongate object in a desired display orientation of the informational symbol field such that the embossment alignment direction is substantially parallel to the longitudinal axis of the elongate object whereby the flexibility of the planar information display surface is not degraded by the embossments.

16 Claims, 4 Drawing Sheets

20
24
30
4
5
A
32

20
3
34
24

36
22

22
38
36
34
32
30

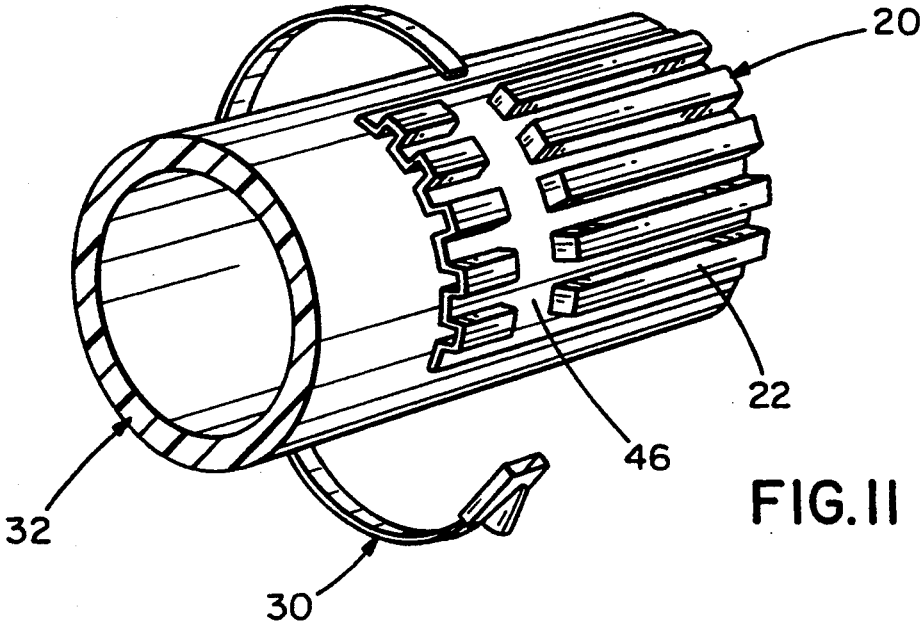
FIG. 11
FIG. 12
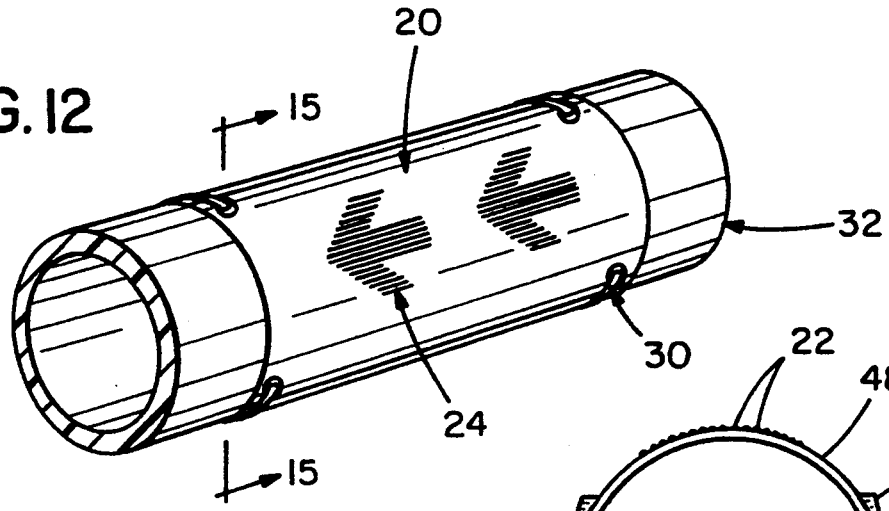
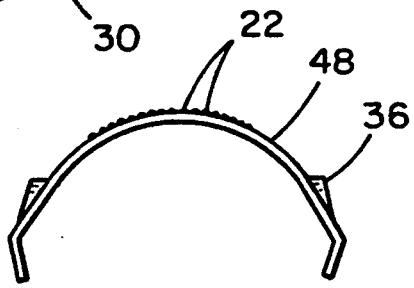
FIG. 14
FIG. 13
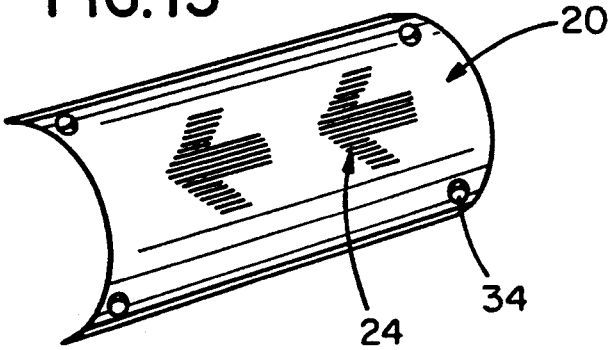
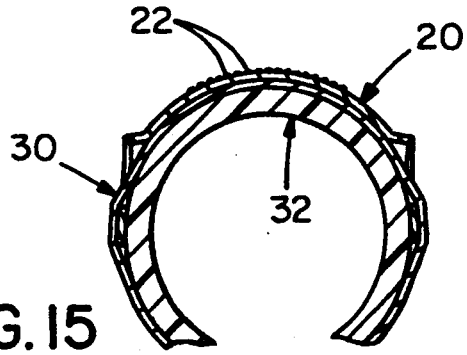
FIG. 15

EMBOSSED PIPE MARKER

TECHNICAL FIELD

The present invention relates to informational labels and specifically relates to labels or markers specially adapted for elongate cylindrical objects such as pipes.

BACKGROUND ART

Various types of pipe markers are known in the art consisting typically of plastic or paper labels that have a painted or printed informational field and are affixed to a pipe by an adhesive layer or secured by mechanical fasteners such as cable ties. Although these markers are satisfactory in non-hazardous environments, the printed or painted informational fields of the paper or plastic labels are subject to destruction in caustic chemical environments or when subjected to high temperatures or fire. Thus information may be lost in the environments and at the times when it is most needed.

Other ridged pipe markers have been suggested that do not conform to the pipe to which they are affixed, leaving projecting sharp edges that pose a threat of injury to workers. See U.S. Pat. No. 4,246,712.

Tight conformity of pipe markers to the covered pipe, especially at the longitudinal peripheral edge of the pipe marker, is desirable since it is common practice to flush the marked pipes with high pressure fluids to clean the pipes.

Thus there is room in the art for an improved pipe marker.

SUMMARY OF THE INVENTION

It is the object of the present invention to provide a pipe marker that can closely conform to the circumference of a pipe and that has an information display field that retains its informational content in high temperature and in corrosive environments.

In general, an information marker for conforming display around an elongate object having a longitudinal axis includes a planar information display surface of sufficient flexibility to conform to the shape of the elongate object, a plurality of embossments in the information display surface arranged to display an information symbol field, wherein longer peripheral edges of each of the embossments are aligned parallel to an embossment alignment direction, and means for securing the marker around the elongate object in a desired display orientation of the information symbol field such that the embossment alignment direction is substantially parallel to the longitudinal axis of the elongate object whereby the flexibility of the planar information display surface is not degraded by the embossments.

BRIEF DESCRIPTION OF THE DRAWINGS

FIG. 11 is a fragmentary perspective view of an alternative embodiment of the present invention showing a pipe marker with a cable tie securing channel defined by corrugations in the pipe marker;

FIG. 12 is a perspective view of an arcuate pipe marker embodying the concept of the present invention shown secured around a pipe marker;

FIG. 13 is a perspective view of the pipe marker of FIG. 12 before it is secured around a pipe;

FIG. 14 is an end view of the pipe marker of FIG. 3; and

FIG. 15 is a sectional view taken along line 15—15 of FIG. 12.

DESCRIPTION OF THE PREFERRED EMBODIMENTS

Figure 1:
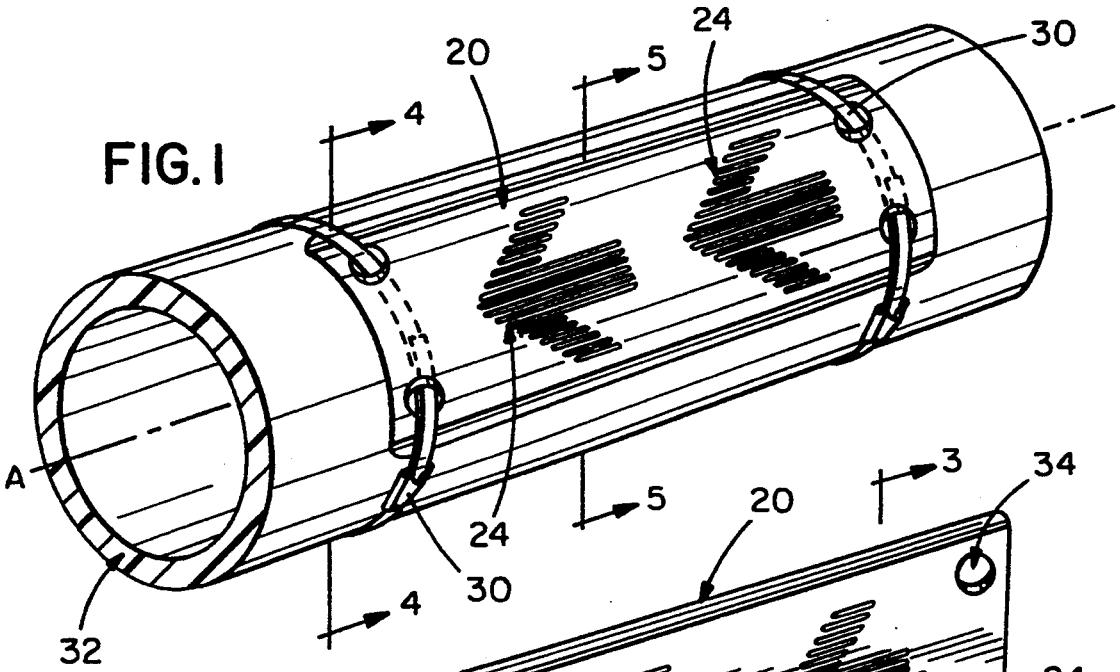
FIG. 1 is a perspective view of a pipe marker embodying the concept of the present invention shown secured around a pipe.
Figure 2:
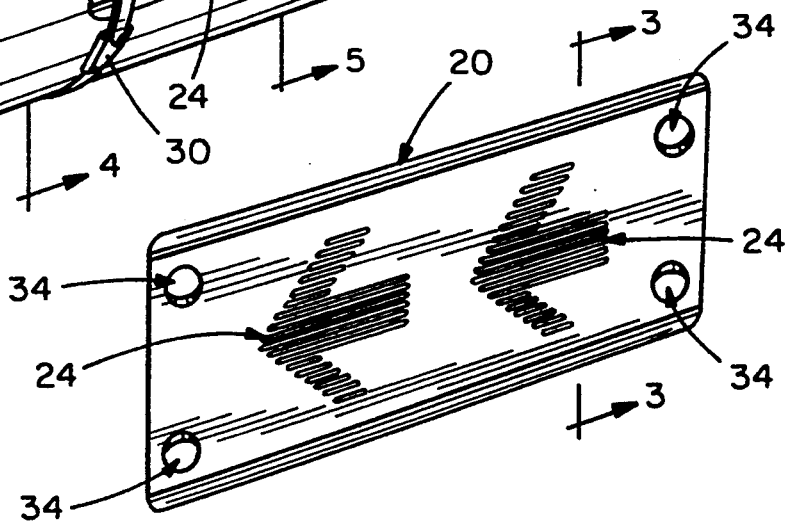
FIG. 2 is a perspective view of the pipe marker of FIG. 1, shown in a planar undistorted disposition.
Figure 3:
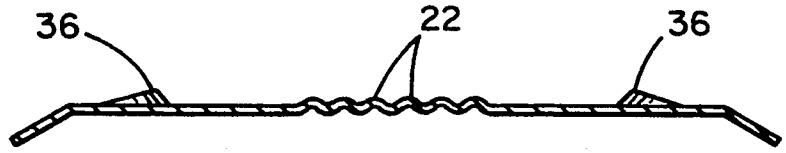
FIG. 3 is a sectional view taken along line 3—3 of FIG. 2.
Figure 4:
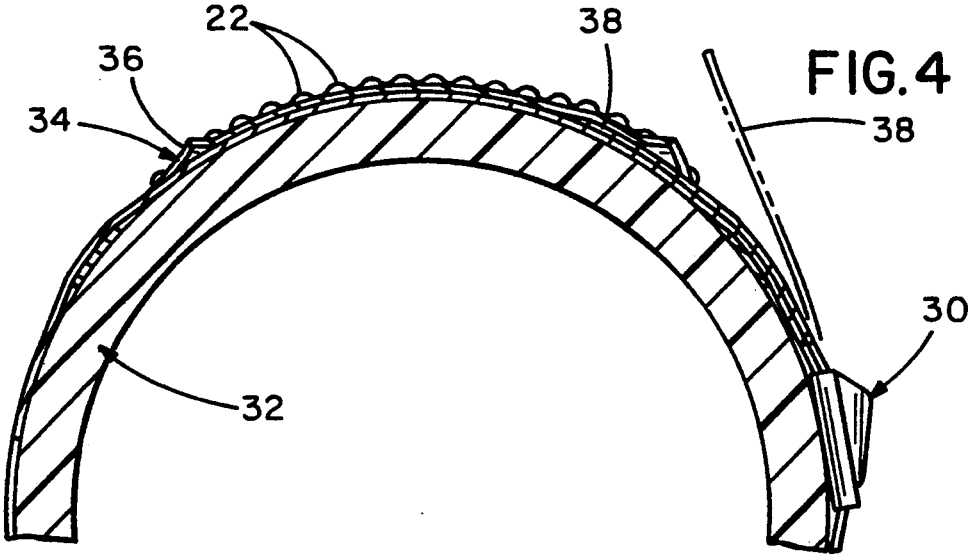
FIG. 4 is a fragmentary partial sectional view taken along line 4—4 of FIG. 1.

A pipe marker embodying the concept of the present invention is generally designated by the numeral 20 in the accompanying drawings. Preferably, pipe marker 20 is formed of a planar sheet of 0.005 inches (0.0127 cm.) thick stainless steel having a plurality of elongate embossments 22 formed in a pattern on the surface of pipe marker 20 to define an information field 24 shown in FIGS. 1,2,12 and 13 as an arrow directional symbol and in FIGS. 8–10 as alphabetic symbols, although any grouping of embossments, either due to the presence (FIG. 1) or absence (FIG. 9) of embossments that conveys desired information is contemplated by our invention.

Pipe marker 20 is preferably painted, with the information field 24 being painted a conspicuous contrasting color.

Figure 8:
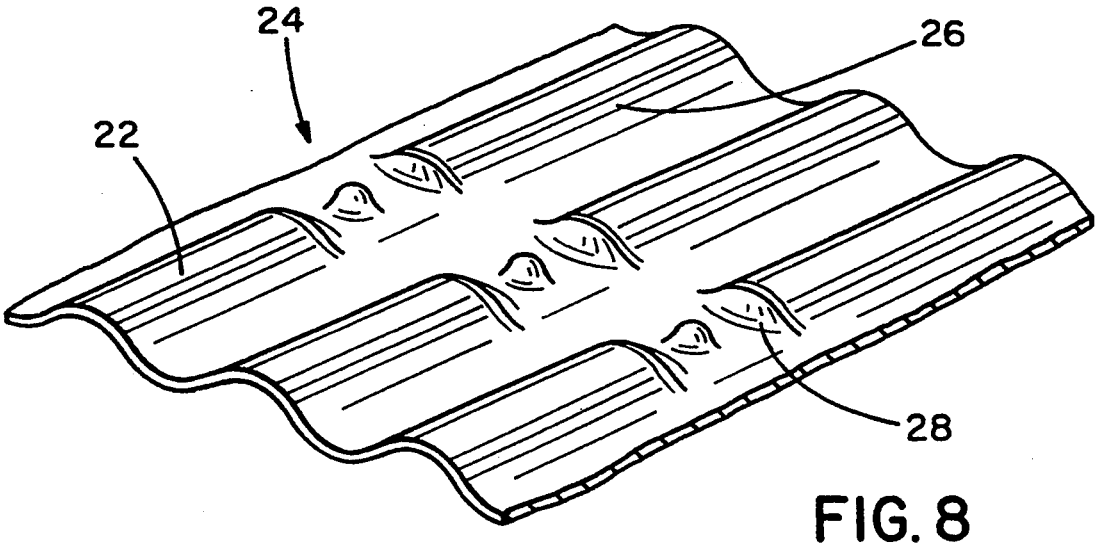
FIG. 8 is a fragmentary perspective view of sinusoidal corrugations that may be used to form the information field of the pipe marker of FIG. 1.
Figure 9:
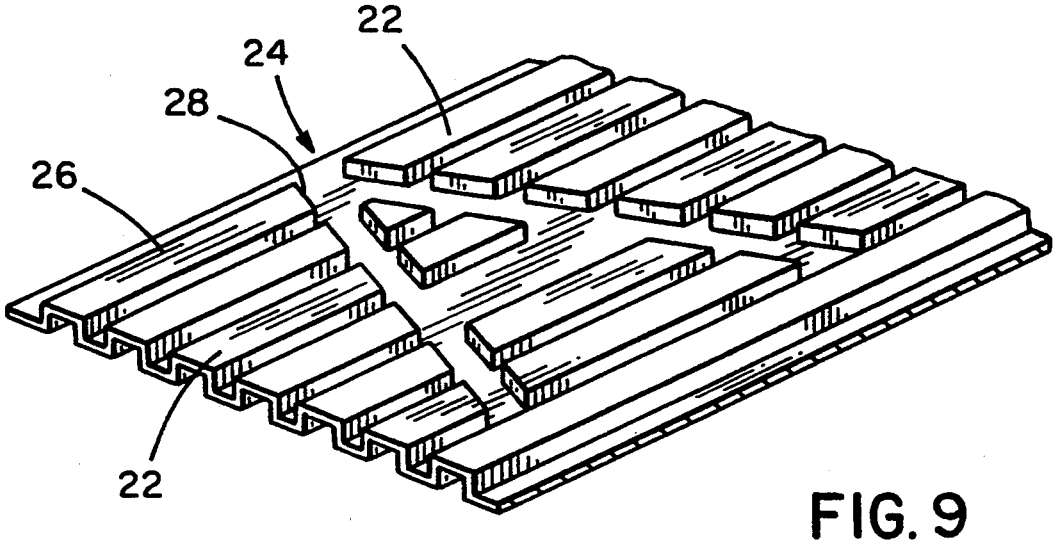
FIG. 9 is a fragmentary perspective view of rectangular corrugations that may be used to form the information field of the pipe marker of FIG. 1.
Figure 10:
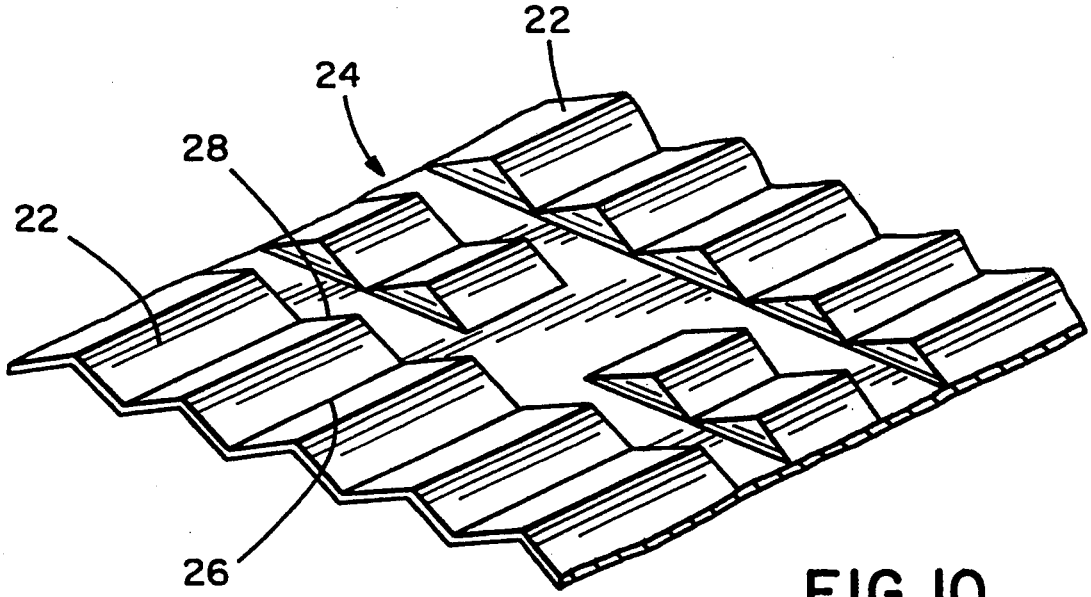
FIG. 10 is a fragmentary perspective view of angular corrugations that may be used to form the information field of the pipe marker of FIG. 1.

As best seen in FIGS. 8–10 each individual embossment 22 in field 24 has a long peripheral edge 26 and a short peripheral edge 28. As seen in FIG. 1, pipe marker 20 is designed to be secured by a fastener 30 in conforming disposition around a cylindrical object such as pipe 32 having a longitudinal axis illustrated by imaginary line designated A in FIG. 1. Pipe 32 may have a range of diameters, for example, a 1.5 inch (3.8 cm.) by 8 inch (20.3 cm.) pipe marker, 0.005 inches (0.013 cm.) thick will conform to a range of pipes 32 having diameters of 0.75 inches (1.9 cm.) to 2.124 inches (5.4 cm.). Longer peripheral edges 26 (FIGS. 8–10) of each embossment are preferably aligned parallel to longitudinal axis A of pipe 32 with the long peripheral edge 26 of each embossment 22 being substantially parallel to longitudinal axis A of pipe 32 such that the flexibility of marker 20 is not degraded by embossments 22.

Pipe marker 20 preferably includes a plurality of apertures 34 that accept fastener 30 which preferably is a stainless steel cable tie described in U.S. Pat. No. 4,399,592 to Chopp, Jr. et al. Formed adjacent inward edges of each aperture 34 is an indentation 36 which is formed outwardly to provide a funnel like inward guide surface that facilitates insertion of fastener 30 into and through apertures 34. Indentations 36 are formed with sufficient height to allow insertion of a free end 38 of fastener 30 into overlapping disposition with the strap of fastener 30 beneath marker 20 allowing application of fastener 30 without requiring severance of the excess free end portion of the strap of fastener 30 and preventing inadvertent engagement with free end 38.

Figure 5:
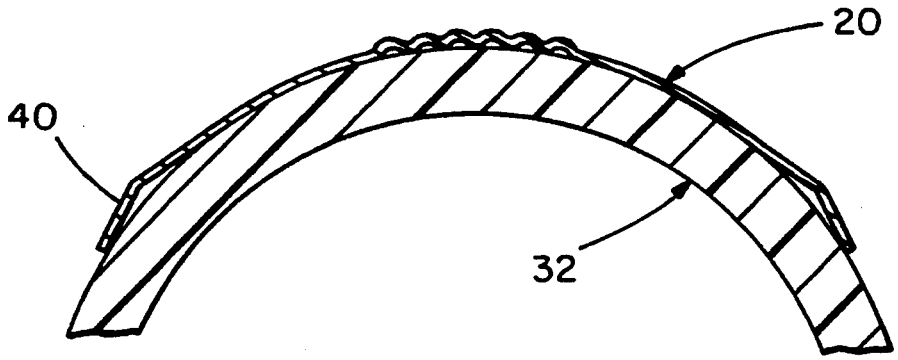
FIG. 5 is a sectional view taken along line 5—5 of FIG. 1.
Figure 6:
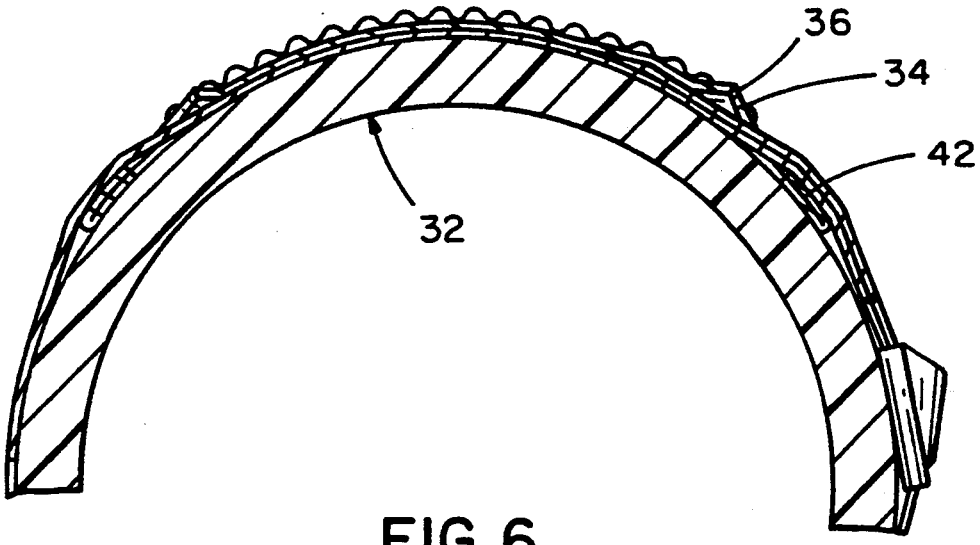
FIG. 6 is a sectional view, similar to FIG. 4, of a second embodiment of the present invention having inwardly folded peripheral edges.
Figure 7:
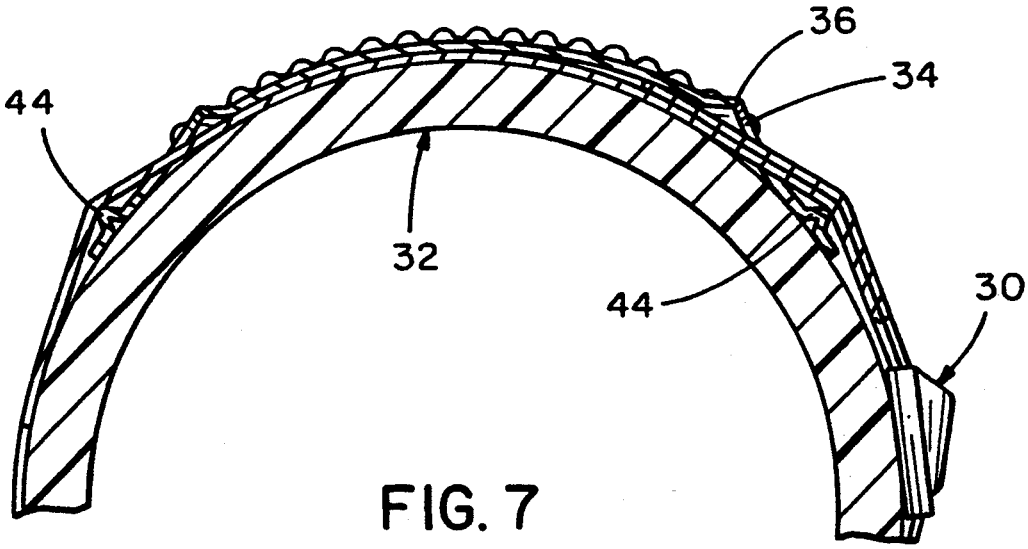
FIG. 7 is a sectional view, similar to FIG. 4, of a third embodiment of the present invention having upwardly formed V-shaped ridge edges.

As seen in FIG. 5, pipe marker 20 includes inwardly formed peripheral longitudinal edges 40 that effect close conformation of pipe marker 20 with pipe 32. Edges 40 each comprise a longitudinal peripheral portion of pipe marker 20 that is bent inwardly, along a line, out of the plane of pipe marker 20. Second and third embodiments of formed peripheral edges which also effect close conformation of pipe marker 20 with pipe 32 are respectively illustrated in FIGS. 6 and 7, FIG. 6 illustrating inwardly folded edges 42 and FIG. 7 illustrating upwardly formed V-shaped ridge edges 44.

Inwardly folded edges 42 each comprise a longitudinal peripheral portion of pipe marker 20 that is folded inwardly 180 degrees to a position beneath pipe marker 20. V-shaped edges 44 comprise a ridge having a V-shaped profile formed upwardly and spaced inwardly from the peripheral edge of pipe marker 20.

Another means for securing pipe marker 20 to pipe 32 is illustrated in FIG. 11. Aligned discontinuities in the information field of embossments 22 define a fastener positioning channel 46, preferably disposed adjacent each end of marker 20, that accepts fastener 30, embossments 22 preventing movement of marker 20 in the longitudinal direction.

FIGS. 12–15, disclose another embodiment of the present invention identical to the above described marker 20 in all respects but with the additional feature of a permanent deformation of the medial portion of planar marker 20 into a medial arcuate section 48 extending from a point adjacent indentation 36 across the width of marker 20 to a point adjacent opposing indentation 36. Medial arcuate section 48 preforms marker 20 allowing improved conformity of marker 20 around smaller diameter pipes and thus enhances the conformity of the peripheral longitudinal edges of pipe marker 20 to pipe 32.

While the particular embodiments of the present invention have been shown and described, it will be obvious to those skilled in the art that changes and modifications may be made without departing from the invention in its broader aspects. The matter set forth in the foregoing description and accompanying drawings is offered by way of illustration only and not as a limitation. The actual scope of the invention is intended to be defined in the following claims when viewed in their proper perspective based on the prior art.

We claim:

1. Information marker for conforming display around an elongate object having a longitudinal axis, comprising:

planar information display surface of sufficient flexibility to conform to the elongate object;

a plurality of parallel embossments in the information display surface arranged to display an information symbol field, wherein each embossment includes a short peripheral edge and a longer peripheral edge of greater length than the short peripheral edge and wherein the longer peripheral edges of each of the embossments are aligned parallel to an embossment alignment direction; and means for securing the marker around the elongate object in a desired display orientation of the information symbol field such that the embossment alignment direction is adapted to be substantially parallel to the longitudinal axis of the elongate object and thus the longer peripheral edges of the embossments are disposed such that the flexibility of the planar information display surface is not degraded by the embossments.

2. An information marker as set forth in claim 1, including edge conformation means for effecting close conformation to the elongate object of peripheral edges of the information marker parallel to the longitudinal axis of the elongate object.

3. An information marker as set forth in claim 2, wherein the edge conformation means includes a longitudinal peripheral portion of the information marker that is bent inwardly out of a plane of the planar information display surface.

4. An information marker as set forth in claim 2, wherein the edge conformation means includes a longitudinal peripheral portion of the information marker that is folded inwardly 180 degrees.

5. An information marker as set forth in claim 2, wherein the edge conformation means includes a V-shaped ridge formed upwardly out of a plane of the planar information display surface.

6. An information marker as set forth in claim 1, including a plurality of fastener accepting apertures having outwardly formed indentations that are disposed on inward edges of the apertures of sufficient height such that the indentations guide a free end of a fastener inserted into the apertures and accept and retain the free end underneath the information marker.

7. An information marker as set forth in claim 1, including a fastener positioning channel formed in the information marker and defined by an absence of embossments.

8. An information marker as set forth in claim 1, including a permanently deformed arcuate section medially formed in the information marker such that the information marker is preformed to conform to the elongate object whereby the information marker has improved conformity to a smaller diameter of elongate objects.

9. An information marker as set forth in claim 8, including edge conformation means for effecting close conformation to the elongate object of peripheral edges of the information marker parallel to the longitudinal axis of the elongate object.

10. An information marker as set forth in claim 9, wherein the edge conformation means includes a longitudinal peripheral portion of the information marker that is bent inwardly out of a plane of the planar information display surface.

11. An information marker as set forth in claim 9, wherein the edge conformation means includes a longitudinal peripheral portion of the information marker that is folded inwardly 180 degrees.

12. An information marker as set forth in claim 9, wherein the edge conformation means includes a V-shaped ridge formed upwardly out of a plane of the planar information display surface.

13. An information marker as set forth in claim 8, including a plurality of fastener accepting apertures having outwardly formed indentations that are disposed on inward edges of the apertures of sufficient height such that the indentations guide a free end of a fastener inserted into the apertures and accept and retain the free end underneath the information marker.

14. An information marker as set forth in claim 8, including a fastener positioning channel formed in the information marker and defined by an absence of embossments.

15. Information marker for conforming display around an elongate object having a longitudinal axis, comprising:

planar information display surface of sufficient flexibility to conform to the elongate object;

an information symbol field disposed on the information display surface;

means for securing the marker around the elongate object in a desired display orientation of the information symbol field; and edge conformation means for effecting close conformation to the elongate object of peripheral edges of the information marker parallel to the longitudinal axis of the elongate object, wherein the edge conformation means includes a longitudinal peripheral portion of the information marker that is bent inwardly out of a plane of the planar information display surface.

16. An information marker for conforming display around an elongate object having a longitudinal axis, comprising:

planar information display surface of sufficient flexibility to conform to the elongate object;

an information symbol field disposed on the information display surface;

means for securing the marker around the elongate object in a desired display orientation of the information symbol field; and edge conformation means for effecting close conformation to the elongate object of peripheral edges of the information marker parallel to the longitudinal axis of the elongate object, wherein the edge conformation means includes a V-shaped ridge formed upwardly out of a plane of the planar information display surface.

* * * * *